United States Patent [19]

Ferguson

[11] Patent Number: 4,965,917

[45] Date of Patent: Oct. 30, 1990

[54] BOBBIN STRIPPING SYSTEM

[76] Inventor: John H. Ferguson, P.O. Box 116, Linwood, N.C. 27299

[21] Appl. No.: 375,597

[22] Filed: Jul. 5, 1989

[51] Int. Cl.[5] ..... B24C 1/00

[52] U.S. Cl. ..... 28/295

[58] Field of Search ..... 28/295

[56] References Cited

U.S. PATENT DOCUMENTS

| | | | |
|---|---|---|---|
| 1,739,775 | 12/1929 | Baker | 28/295 |
| 2,303,048 | 12/1942 | Hudson | 28/295 |
| 3,640,163 | 2/1972 | Giardini et al. | 28/295 X |

*Primary Examiner*—Werner H. Schroeder
*Assistant Examiner*—Bradley Kurtz DeSandro
*Attorney, Agent, or Firm*—Donald L. Weinhold, Jr.

[57] ABSTRACT

An improved textile bobbin cleaning system for removing fiberglass remnants, rovings, yarn, waste or the like from a textile fiber spool, core or bobbin in order that same may reused to store or rewind with new textile fibers, threads, yarn or the like. The invention utilizes an endless indexing conveyor system which aligns bobbins which need to be stripped of remnant fibers before a geared oscillating water jet cutting system which hydraulically cleans the bobbins by cutting the fiber remnants. A pneumatic clamping system has the flexibility and utility to secure bobbins of different design and dimension for the hydraulic stripping action. In addition, a sealed waste conveyor carries away the fibrous waste designed to eliminate waste accumulation on the conveyor mechanism and removes the cuttings for disposal. Also a bobbin removal conveyor is provided for which removes processed and cleared bobbins from the cleaning area to be packaged for transporting for further bobbin usage.

20 Claims, 7 Drawing Sheets

BOBBIN STRIPPING SYSTEM

BACKGROUND OF THE INVENTION

In the textile industry, particularly, the use of bobbins or spools are used to wind, take up, or transport yarn, thread, fibers or rovings. The spool or bobbins are generally made of a reuseable core material. When the rovings, yarn, or fiber has been used or nearly used, the used bobbin is discarded and replaced by a full one. As the used bobbins accumulate they are collected for reuse. However, before new thread or yarn can be rewound on the used spool or carrier core, any roving remnants must be removed.

Many different methods for removing remnant fibers have been attempted with variable success but the process is made even more difficult with certain fibers such as fiber glass, or loose fitting threads which tend to merely slide circularly around the core.

Once fibers have been removed, the waste material must be collected and removed. Such removal is generally messy, ineffective, and incomplete at best and usually requires additions separate and ongoing cleanup efforts which are time-consuming and expensive.

SUMMARY OF THE INVENTION

The present invention has been designed and engineered to overcome many disadvantages of the present state of the art. The instant invention discloses an integrated bobbin cleaning system which systematically positions bobbins before an innovative hydrodynamic cutting unit which removes all fiber remnants and which removes the resulting stringy waste and deposits cleaned bobbins for packaging for reuse.

Basic design includes many novel features such as high pressure oscillating water jets which are geared to provide a series of high pressure water streams which are directed to a bobbin to be cleaned so that the streams of water cut and remove the fibrous waste, of virtually any thickness by the water pressure and the cutting action of a precision pattern of the pair of water streams, which create a scissors-type effect and providing a virtual 100% removal rate.

In addition, an endless indexed conveyor system which may accommodate any size bobbins has been designed to precisely position and pneumatically hold used bobbins for the water cutting action of the innovative system. Moreover, a sealed conveyor system has been designed to remove the wet stringy mass of removed remnants which is both effective and relatively trouble free.

As a major object of this invention, an amazingly effective and efficient method to remove fibrous remnants of virtually any material, thickness or size for bobbins of different internal diameters and design has been provided which overcomes the disadvantages of other systems designed for the same purpose, but which has less than total removal experience.

It is therefor an object of the present invention to provide an improved bobbin stripper system which may be implemented in a variety of layout designs to accommodate various industrial structures and physical layouts.

It is a further object of my invention to provide a conveyor system which is more effective and more efficient than those systems heretofore known and used.

It is yet another object of my invention to provide a bobbin stripping system which will carry away the wet stringy waste without interruption or damage due to clogging of the exit conveyors of my present invention.

Other objects and advantages of the present invention will become apparent to those skilled in the art after considering the following specification which disclose a preferred embodiment thereof in conjunction with the accompanying drawings, wherein:

DETAILED DESCRIPTION OF THE DRAWINGS

Figure 1:
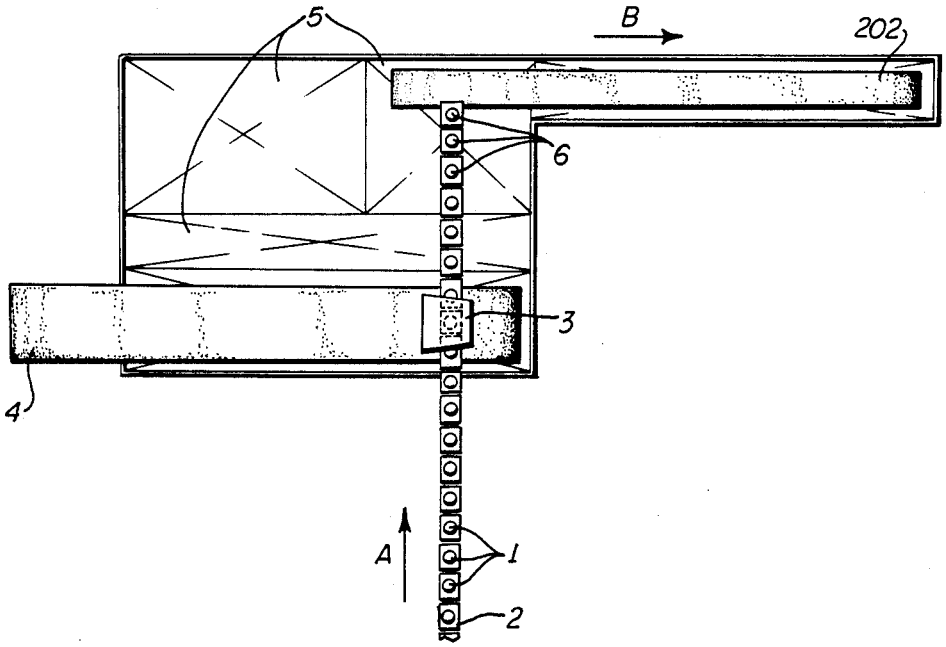
FIG. 1 is a graphic plan view of the system's general layout of my present invention.

Referring to the drawings, wherein like reference numerals indicate like parts, various views of the preferred embodiment are shown.

Referring first to FIG. 1, a basic system layout is illustrated wherein bobbins, 1, having fibrous remnants which need to be removed are fed by stripper conveyor, 2, in direction A toward a hydraulic cutting chamber, 3, where the fibrous remnants are removed. Removed waste fibers are carried away by waste conveyor, 4.

Excess water runoff after hydraulic cutting is collected in settling chambers, 5, which also collect any waste fiber not carried by waste conveyor, 4. Cleaned bobbins, 6, exit from cutting chamber, 3, and are deposited on bobbin removal conveyor, 202, which carries cleaned bobbins for packaging in direction, B.

Referring now to FIGS. 5, 6, 7, and 8, a bobbin conveyor is shown generally at 8 which is confined within vertical frame, 9. Tubular support members, 200, add internal support to frame, 9. For additional support, frame 9 is provided with integral support members, 10, which may be rigidly attached to the extremities of frame 9 or formed with frame 9, by bending at a 90 degree angle. Located above integral support member, 10, is a wear surface, referred to as spindle plate support, 11, which will be more fully described. Conveyor chain sprocket, 12, is supported by axles, 13 and 14, which are journaled in bearings 21, 22, 23, and 24. Axles 13 and 14 are supported by pairs of take-up frames 25 and 26. Take up frame 26 is fixedly attached to frame 9 by any expedient means such as pins 27 which pass through lockdown plate 32. Take up frame 25 is slideably attached to frame 9 by pins, 28, which permit take up frame 25 to slide by means of slot pairs 29 and 30 located in slide plate, 33. By releasing tension on pins 28, take up frame 25 may be removed along slots, 29 and 30, to adjust the tension in chain, 31 shown in FIG. 8. Upon reaching proper chain tension, pins, 28, are tightened into position. Continuous chain, 31, is driven by any prime mover graphically shown in FIG. 5 at 40. Located at spaced intervals along the length of chain, 31 are connectors, 41 upon which are secured spindle plates 45. Bobbin spindles, 46 are fixedly attached to spindle plate, 45 and are designed to carry bobbins, 47 which may be easily placed into slideable registry with spindle, 46. Obviously, as chain, 31 travels in a circular motion around sprocket, 12, bobbins, 47, are caused to be deposited by action of gravity as the bobbins, 47 pass position C.

Referring now to FIGS. 9, 10, 11, 12, 13, 14, 15, 16, 17, and 18, the bobbin stripper or cutter elements are more specifically shown. As bobbins, 47, are directed by bobbin conveyor, 8, to stripper mechanism, 50, each bobbin, 47, is drawn into stripper hood, 51, which is designed with openings, 52, through which bobbin conveyor, 8, and bobbins, 47, are permitted to pass. A flow of water is forced through a multitude of conduits, 53, and ultimately through stripper nozzles, 54, which direct a high pressure stream of water toward bobbin, 47, upon which fibrous remnants are located for removal. Each conduit, 53, is provided with a stripper nozzle, 54, which is any expedient design to create a high pressure stream of water directed over a relatively short distance to contact a concentrated point of impact on bobbins, 47, for fiber remnant removal. Stripper hood, 51, is also designed with open front, 55, within which stripper conduits, 53, and nozzles, 54, are located. Stripper hood, 51, is further designed with closed sides, 57 and 58 and back, 59, which is designed to direct the wash spray reflecting off of bobbin, 47, along with the removed fiber as waste in a downward direction, D, and ultimately washed onto waste conveyor, 4. Waste conveyor, 4, allows waste water to be drained off for collection in settling chambers, 5, as shown in FIG. 1 with the fibrous waste being deposited on waste conveyor, 4, for discharge as hereinafter disclosed.

Stripper nozzles, 54, enhance their cutting action in three primary ways. First of all, multiple conduits, 53, and nozzles, 54, amplify the impact of one nozzle by a factor equal to the total number of stripper nozzles provided. Secondly, in order to direct the stream of water onto the full length of bobbin, 47, nozzles, 54, are caused to move longitudinally along a vertical plane by an oscillating mechanism, hereinafter described. Thirdly, the high pressure water streams are oscillated such that the waste streams alternatingly intersect each other at a point of impact along the length of bobbin, 47, creating a cutting or scissor type action.

To facilitate the oscillation cutting action as described, nozzles, 54, are removeably attached to the free end of each conduit, 53. Opposite ends of each conduit, 53, are removeably attached by any convenient means such as threaded mating surfaces, to a separate small cubical connector, 56, which is integrally engaged around separate hollow gear shafts, 61. As each gear shaft, 61 is caused to rotate, as hereinafter described, each connector, 55, and conduit, 53, are caused to also rotate. Each hollow gear shaft, 61, receives a separate water supply line, 66, which supplies water to each nozzle, 54.

Figure 12:
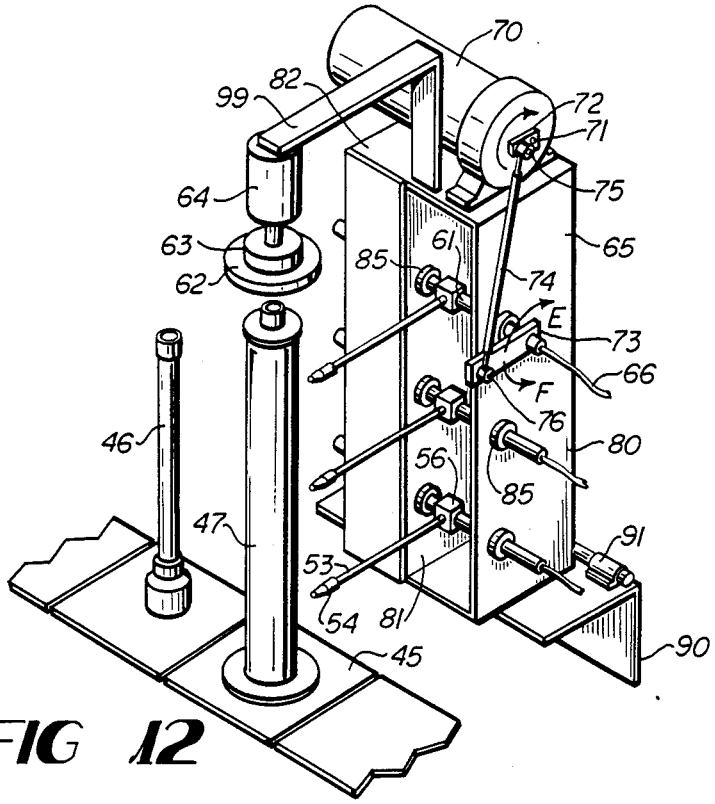
FIG. 12 is a perspective view of the stripper mechanism of my present invention.
Figure 13:
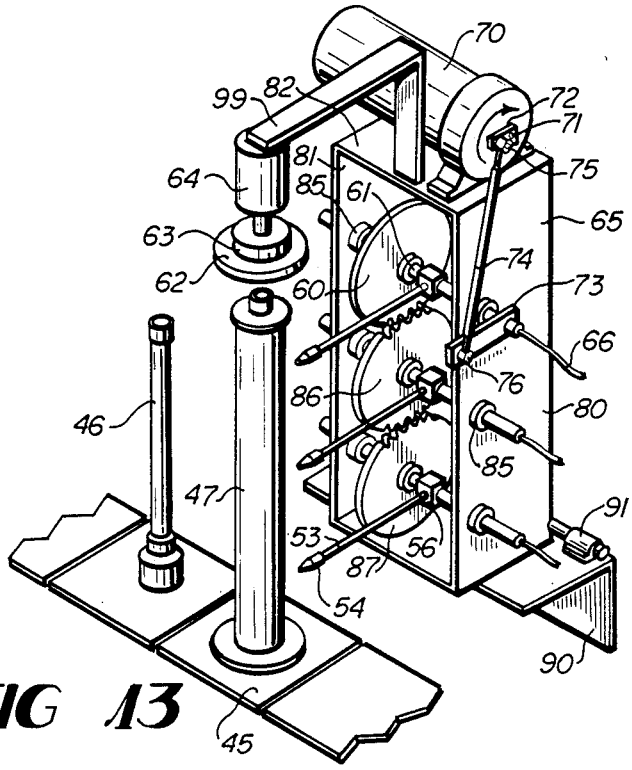
FIG. 13 is a perspective view of the gearing arrangement of the stripper mechanism of my present invention.

Any prime mover, such as stripper motor, 70, rotates motor shaft, 71, which in turn causes stripper motor drive arm, 72, to rotate. As stripper motor drive arm 72, rotates, stripper shaft drive arm, 73, is caused to oscillate in direction E & F by means such as tie rod, 74, which is connected off-center to stripper motor drive arm, 72, and stripper shaft drive arm 73. Tie rod, 74, is rotatably attached at one end to stripper motor drive arm 72, by means of bearing, 75, and likewise to one end of stripper shaft drive arm, 73, by means of bearing, 76, the opposite end of stripper motor drive arm being fixedly attached to the first of gear shafts 61. Obviously, as stripper motor drive arm is caused to oscillate, so does uppermost gear shaft, 61 in direction E & F. Supporting gear shaft, 61 is stripper system frame, 65, which is a rigid frame pivotally supported by stripper system frame support member 90, by any convenient means as shown in FIGS. 12 and 13 such as pivot bracket, 91. Pivot bracket 91 permits the entire stripper system to be pivoted for easier access when maintaining or servicing said stripper system. Stripper system frame, 65, consists of opposite sides, 80 and 81, and top, 82. Gear shafts, 61 are journaled horizontally through walls 80 and 81 so that each shaft, 61, is located in a spatial relationship vertically, each shaft being located one below the other. Bearing pairs, 85, support each shaft, 61, in stripper system frame, 65, permitting free rotational oscillation of shafts, 61, as previously described. Connectors, 56, are located intermediate bearing pairs, 85 and within stripper system frame, 65.

Figure 14:
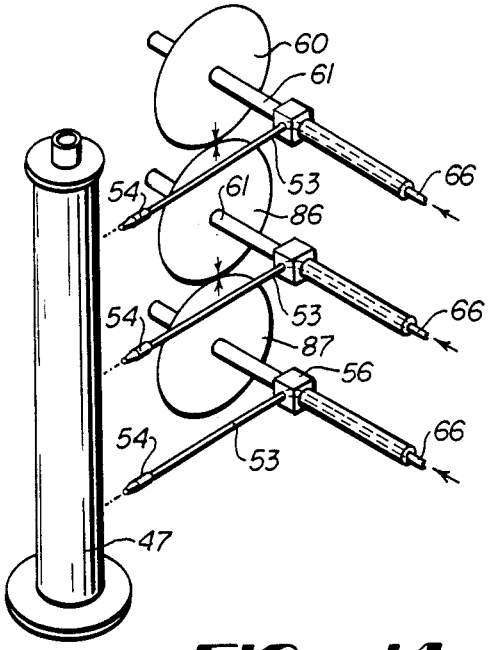
FIG. 14 is a graphic perspective view of stripper mechanism of my present invention.

Integrally attached to uppermost gear shaft, 61, intermediate bearing pairs, 85, is gear 60, which also oscillates in direction E and F as does gear shaft, 61. The teeth of gear 60, mesh with the teeth of adjacent gear, 86, which is likewise caused to mesh with adjacent gear, 87. Each gear is integrally attached to its associated shaft, 61, as shown in FIGS. 13 and 14, so that as the uppermost shaft, 61, is cause to oscillate as hereinbefore described, in direction E, gear 86 and its associated shaft, 61, move in opposite direction, F and adjacent gear 87 and its associated shaft 61 move in direction E. Similarly as gear 60 is caused to oscillate in opposite direction F, completing one cycle, adjacent gear 86 and its associated shaft, 61 moves in direction E and gear 87 and its associated shaft, 61 moves in direction F. It can thus be seen that nozzles, 54, are caused to oscillate longitudinally along the facing surface of bobbin 47, creating the cutting action previously described.

Figure 15:
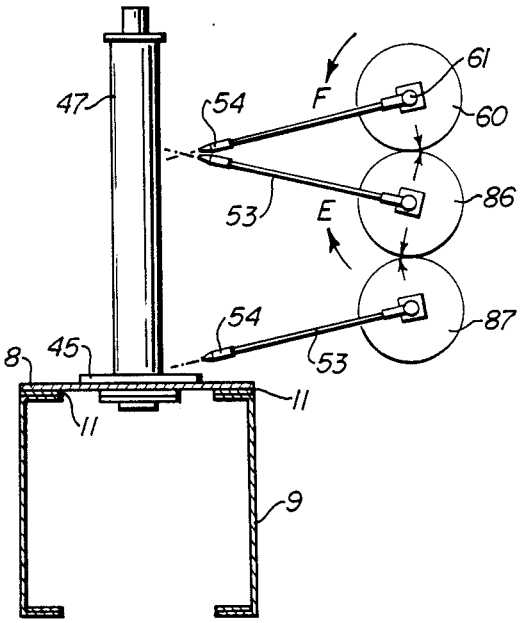
FIG. 15 is an elevational graphic view of the operation of the stripper mechanism of my present invention showing one cutting position.
Figure 16:
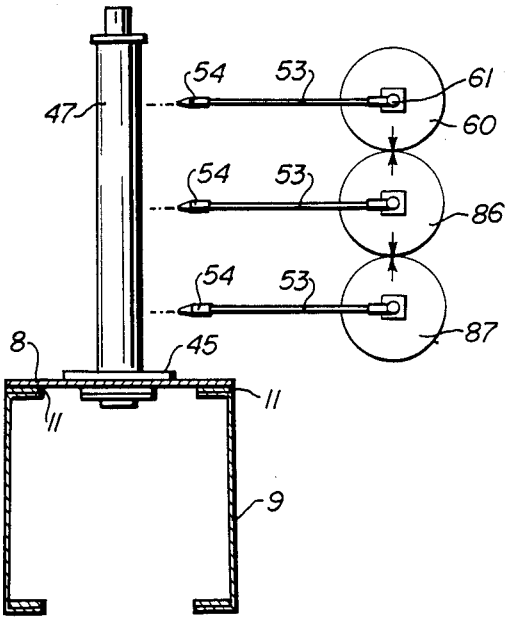
FIG. 16 is an elevational graphic view of the operation of the stripper mechanism of my present invention showing another cutting position.
Figure 17:
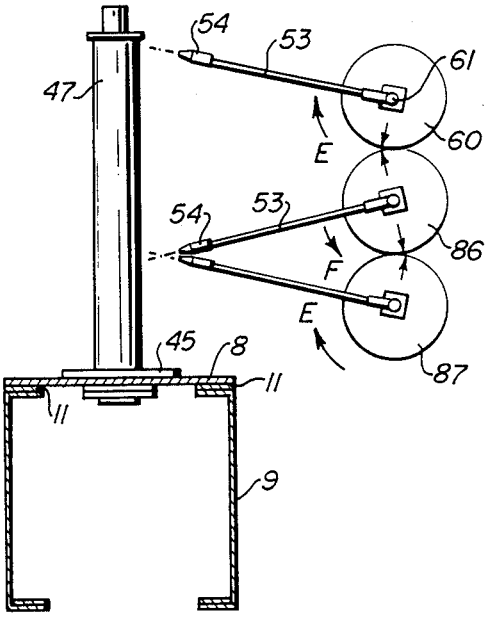
FIG. 17 is an elevational graphic view of the operation of the stripper mechanism of my present invention showing yet another cutting position.
Figure 18:
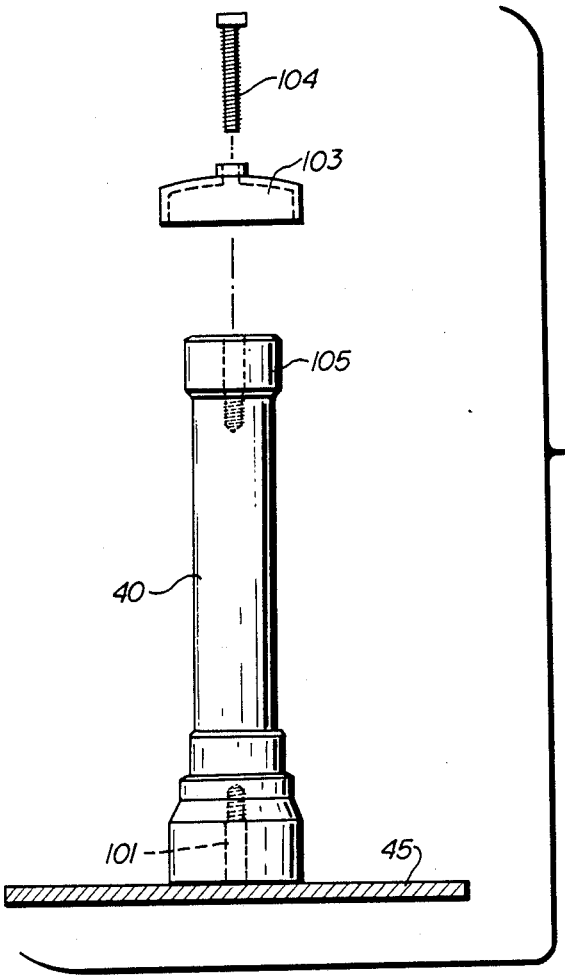
FIG. 18 is an exploded view of a bobbin adapter for an unused spindle element of my present invention.

Referring particularly to FIGS. 15, 16, and 17, three cutting positions are illustrated in a single cutting cycle. FIG. 15 illustrates the extreme position wherein the cutter mechanism oscillates in direction "F". At such position, gear 61 is caused to rotate in direction F thus tilting conduit 53 from its neutral position as shown in FIG. 16, to a downward position as shown in FIG. 15. Simultaneously as gear 60 is caused to rotate in direction F, gear 86 is caused by its interface with gear 60 to rotate clockwise in direction E, likewise moving conduit 53 associated therewith upward toward descending conduit 53 associated with gear 61. High pressure water sprays emanating from each nozzle, 54, associated with gears 60 and 86 are caused therefore to intersect along a longitudinal length of bobbin 47 thereby enhancing the cutting action of any rovings located thereon. Simultaneously with the rotation of gear 60, gear 87 is caused by the interface with gear 86 to rotate in a direction opposite to that of gear 86 and being the same as gear 60, shown as direction F.

In actual operation, the neutral position of nozzles shown in FIG. 16 begins a cutting cycle, which passes through the extreme position shown in FIG. 15 as described above. As the oscillation of gear 60 is driven further in the cycle, gear 60 is caused to return from its limiting position shown in FIG. 15 to the neutral position once again as shown in FIG. 16. As rotation continues in the opposite direction, gear 60 continues to rotate in direction E as shown in FIG. 17 until it reaches its limiting position, carrying with it gear 87 and moving gear 86 in opposite direction, F, causing the high pressure water streams associated with gears 86 and 87 to intersect, also forming a scissors type cutting action to aid in the removal of bobbin rovings. As the movement continues to completion of one cycle, the gears are once again returned to the neutral position shown in FIG. 16 and the cycle is repeated.

Figure 19:
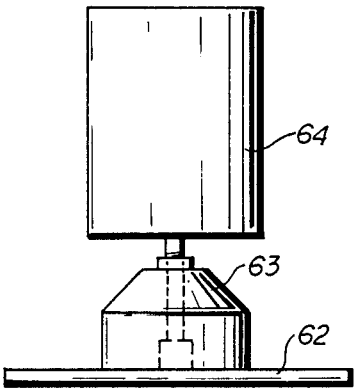
FIG. 19 is a detail graphic elevational view of the pneumatic holding mechanism of my present invention in the retracted position.
Figure 20:
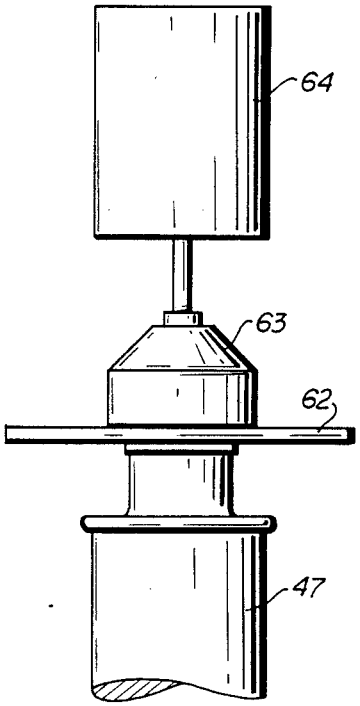
FIG. 20 is a graphic elevational view of the pneumatic holding mechanism and bobbin of my present invention in the clamping position.

In order to secure bobbin 47 from spinning around spindle 46 while the cutting sprays are activated, pneumatic cylinder, 64, as shown in FIGS. 12, 13, 19, and 20 activates a pressure plate, 63 in two vertical directions toward the top of bobbin, 47. Pneumatic cylinder is activated by any convenient expedient ranging from manual activation to computerized automated activation for production timing. Located on the lower side of pressure plate, 63, is a pressure foot plate, 62, designed to engage the top of bobbin 47 so that by the vertical pressure exerted by pneumatic cylinder, 64, pressure foot plate, 62, frictionally engages the top of bobbin, 47, to prevent its free rotation during the cutting action. Pneumatic cylinder is supported from the stripper system frame, 65, by any convenient rigid support such as cylinder support, 99. FIG. 19 illustrates the pneumatic cylinder, 64, in the retracted position, while FIG. 20 illustrates the pneumatic cylinder, 64, in the clamped position.

In order to accommodate bobbins of different sizes and to provide a closer fit between spindle 46 and bobbin 47, a universal size spindle, 46, is provided. As can be best seen in FIG. 18, universal spindle 46 is removably attached to spindle plate, 45, by any expedient means such as threaded stud, 101. Universal spindle 46 is designed to receive smaller internal diameter bobbins to be retained with a minimum tolerance between the external diameter of spindle 46 and the internal diameter of bobbin 47, while at the same time permitting free insertion and gravity removal of the bobbin, 47, from spindle 46. When larger internal diameter bobbins are engaged, interchangeable adapter caps, 103 may be removeably attached to the top of spindle, 46, by any convenient expedient such as attachment bolt, 104. By providing universal spindle, 46, with a threaded receptacle, 105, to securely receive bolt, 104, adapter cap, 103, may be interchanged as necessary. Also, by designing adapter cap 103, to various sizes, a closer tolerance between bobbin, 47 and spindle, 46, may be achieved with the desired result that free spinning of the bobbin 47 on spindle 46 is reduced while still permitting free insertion and removal of bobbin, 47, onto spindle, 46.

Figure 2:
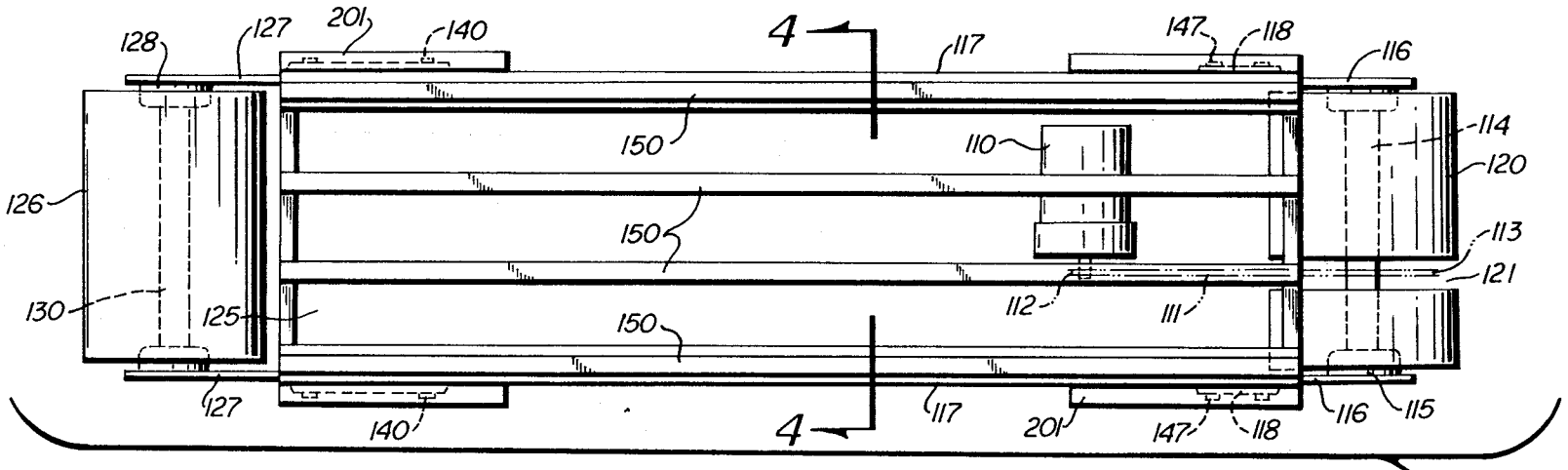
FIG. 2 is a plan view of the exit conveyors of my present invention.
Figure 3:
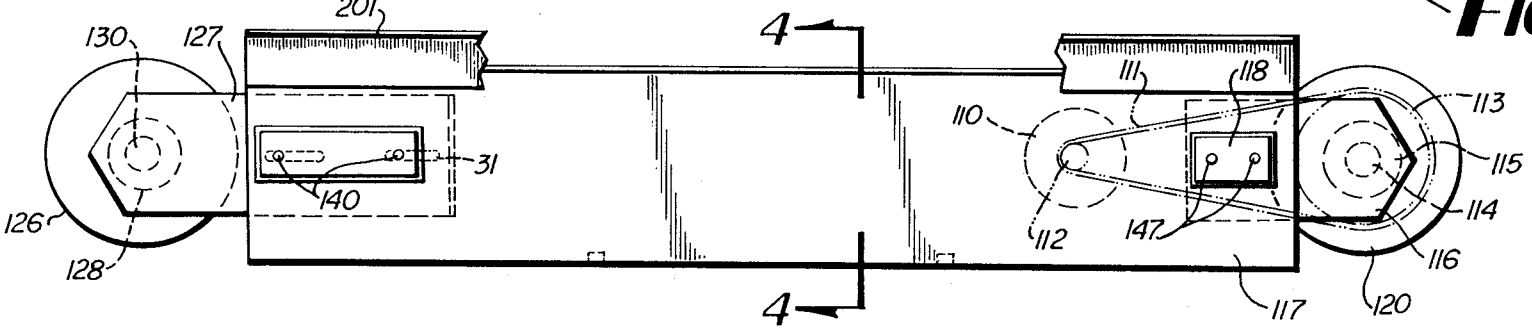
FIG. 3 is a side elevational view of the exit conveyors of my present invention.
Figure 4:
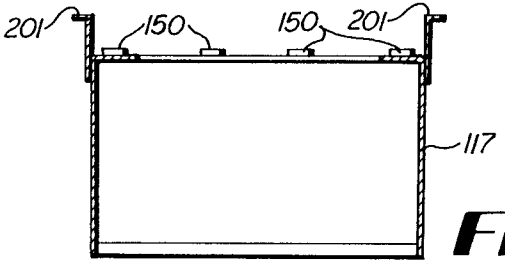
FIG. 4 is sectional view along section 4—4 of FIGS. 2 and 3.
Figure 5:
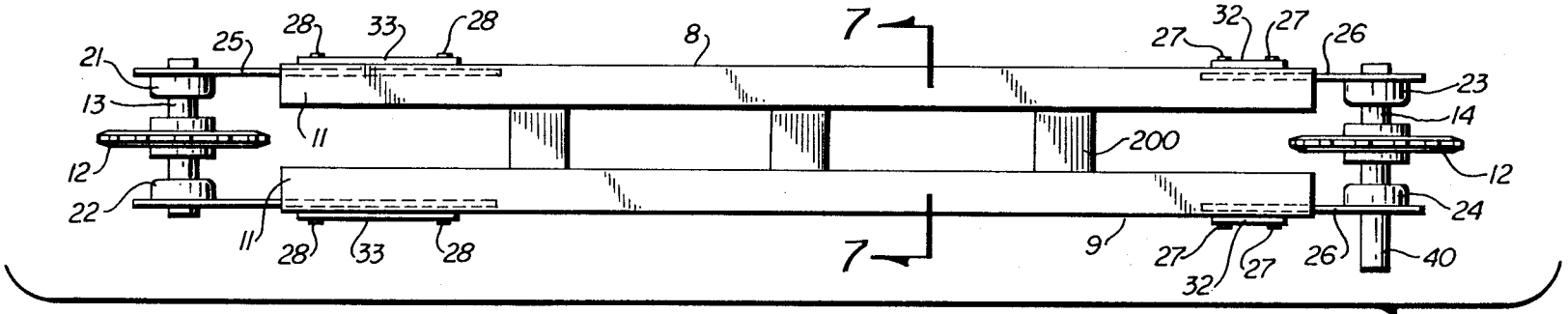
FIG. 5 is a plan view of the bobbin conveyors of my present invention.
Figure 6:
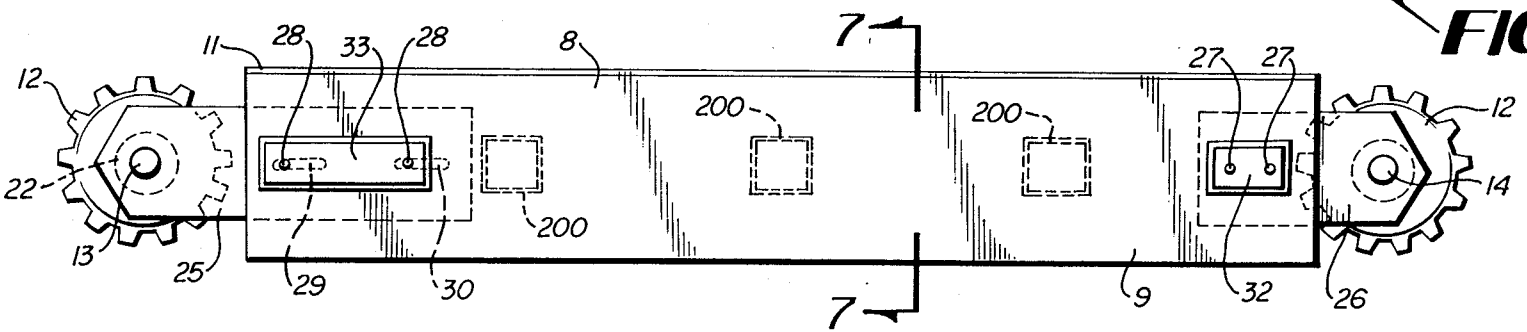
FIG. 6 is a side elevational view of the bobbin conveyors of my present invention.
Figure 7:
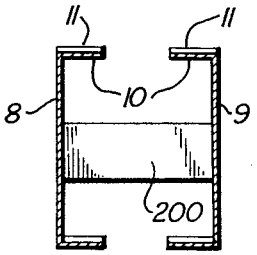
FIG. 7 is a sectional view taken along section 7—7 of FIGS. 5 and 6.
Figure 9:
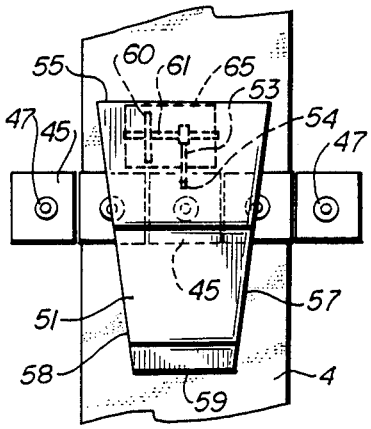
FIG. 9 is a plan view of the stripper mechanism of my present invention.
Figure 8:
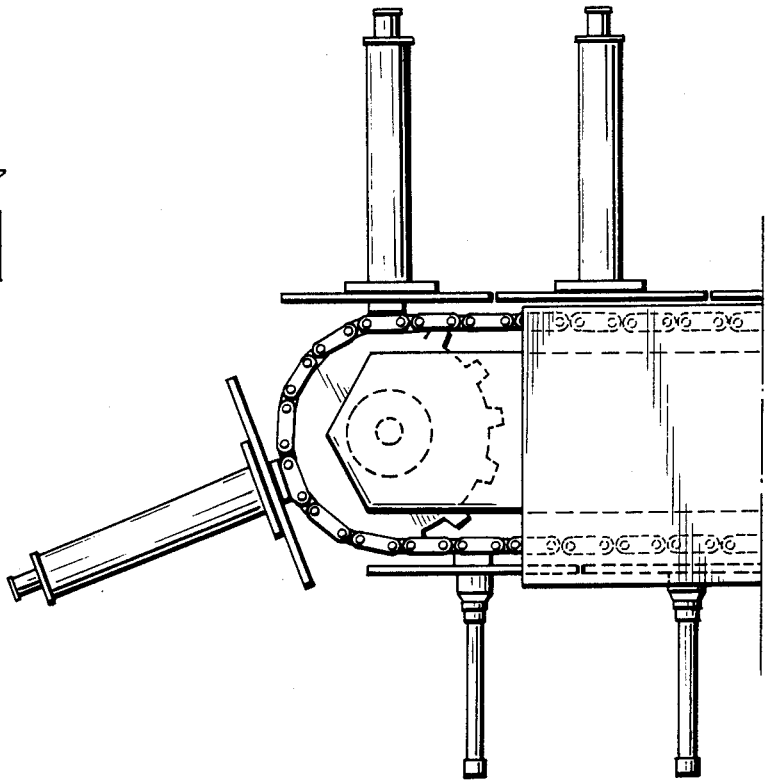
FIG. 8 is a detail view of the end of the bobbin conveyors of my present invention.
Figure 10:
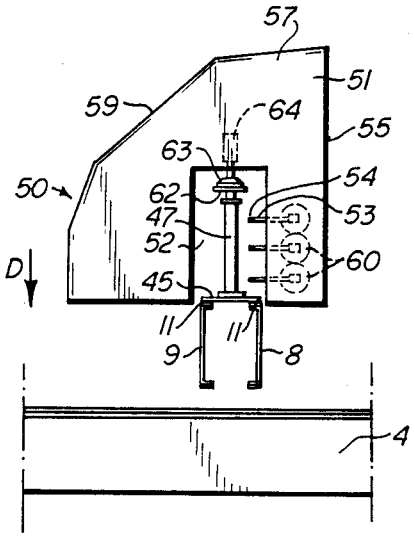
FIG. 10 is a side elevational view of the stripper mechanism of my present invention.
Figure 11:
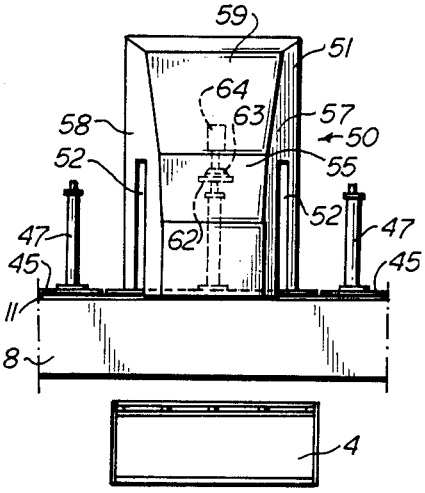
FIG. 11 is a front elevational view of the stripper mechanism of my present invention.

After bobbins, 47, are cleaned as hereinbefore disclosed, the cleared waste material is washed onto sealed waste conveyor, 4, and cleaned bobbins onto similar exit conveyor, 202, as previously described. Waste conveyor, 4, and exit conveyor, 202, are driven by any expedient prime mover, such as drive motor 110 as shown in FIGS. 2 and 3, which drives conveyor, 4 or 202, by means of a drive chain, 111, which engages motor sprocket, 112, and roller sprocket, 113. Roller sprocket, 113, is mounted intermediate the ends of roller shaft, 114, which is rotatably mounted through bearings 115, and journaled into roller support plate pair, 116, which is removeably mounted to conveyor frame 117 by means of a pair of lock down plates, 118 which are secured to frame, 117 by bolts, 145. Also, fixedly attached to roller shaft, 114, is conveyor drive, split roller, 120, having split, 121, to accommodate roller sprocket, 113, as shown in FIG. 2. Therefore, as drive motor, 110, is caused to rotate, so do sprockets 112 and 113, causing roller, 120, to also rotate. Conveyor belt, 125, is comprised of a loop type conveyor belt with one end being driven by roller, 120, which causes belt to move linerly between drive roller 120 and guide roller 126. Guide roller is likewise rotatably supported by takeup conveyor support bracket, 127 through which roller shaft, 130 is journaled through bearings, 128. Takeup conveyor support bracket, 127, is adjustably mounted to conveyor frame, 117, by means of slots, 131, in lock down plate, 132, which may either loosen or tighten belt tension by adjusting take up conveyor support bracket, 127, and tightening into position with any fastening expedient such as bolts, 140.

Conveyor belt, 125, is comprised of an endless loop, passing around the exterior, distal ends of conveyor rollers, 120 and 126, and receive intermediate support by means of rails, 150, which carries waste rovings for final discharge into any convenient waste receptacle. Side rail, 201, is integrally attached to conveyor, 202, in order to prevent loose bobbins from inadvertently falling off of conveyor, 202, during transit.

It should be apparent that an improved bobbin cleaning system has been described. While the invention has been shown in a preferred embodiment, many other modifications, changes, and substitutions in detailed construction and combination, and arrangements of elements may be employed without departing from the spirit and scope of the invention.

I claim:

1. A bobbin stripping system to remove residual rovings and textile fibers from a central core element comprising:

(a) first endless conveyor means to receive and carry bobbins having residual rovings wound thereon;

(b) an automatic stripping device including a series of high pressure fluid nozzles having means to oscillate said nozzles in a vertical plane along the longitudinal axis of said bobbins and directing a high pressure fluid onto the residual rovings to be removed with such pressure and pattern so as the rovings are severed and washed away from said bobbins;

(c) second conveyor means to remove stripped rovings from the stripping device;

(d) third conveyor means to remove stripped bobbins for collection of said bobbins for reuse.

2. The bobbin stripping system of claim 1, wherein first conveyor means is comprised of an endless indexing conveyor which aligns bobbins, one at a time, in a stripping booth for removal of residual rovings.

3. The bobbin stripping system of claim 2, wherein said stripping device is comprised of an odd number of nozzles, each providing a separate high pressure fluid stream and each connected to a separate shaft, and said means to oscillate said nozzles being a vertical series of gears, one gear being mounted to and driving each shaft, the first of which is driven by a motor and each successive gear being driven by its adjacent gear, causing each shaft and attendant nozzle to rotate through a vertical plane thus creating separate high pressure fluid streams directed along said vertical plane which is located along the longitudinal axis of a bobbin to be stripped.

4. The bobbin stripping system of claim 3, wherein adjacent nozzles oscillate in opposite directions, providing pairs of intersecting streams of high pressure fluid.

5. The bobbin stripping system of claim 4, wherein the fluid is water.

6. The bobbin stripping system of claim 5, wherein first conveyor means includes a drive sprocket located at one end thereof, being driven by a prime mover which in turn drives endless conveyor which is comprised of an endless central chain located along the longitudinal axis of the conveyor, said chain being looped around said drive sprocket on the drive end of the conveyor and a second sprocket located at the other end of said conveyor.

7. The bobbin stripping system of claim 6, wherein first conveyor means includes a series of spindle planes comprising a series of multiple flat plates located at spaced interludes along the entire length of said endless chain, thus moving said spindle plates along an endless longitudinal loop, said spindle plates being affixed to said endless chain, so that said spindle plates are located on the outer surface of said conveyor and begin travel along an outer horizonal length in one direction and continuing around the horizontal axis of said second sprocket, perpendicular to the direction of travel of said chain, and turning about said horizontal axis 180 degrees and returning along a horizontal length in the opposite direction before looping vertically about the horizontal axis of said drive sprocket to the point of beginning.

8. The bobbin stripping system of claim 7, wherein a spindle is attached to the outer face of said spindle plate, said spindle comprising an upwardly protruding shaft upon which to releaseably receive a textile bobbin.

9. The bobbin stripping system of claim 8, wherein a bobbin is placed on each spindle as each spindle rotates into the outer horizontal length and being discharged by gravity as the spindle turns downward around said second sprocket, onto said third conveyor means.

10. The bobbin stripping system of claim 9, wherein said spindle is provided with a releasable cap which is of a larger diameter than said spindle in order to accommodate larger bobbins and retain a closer tolerance between the outside diameter of the spindle and the interior diameter of the bobbins.

11. The bobbin stripping system of claim 9, wherein said third conveyor means comprises a sealed endless belt conveyor.

12. The bobbin stripping system of claims 3 or 11, wherein each gear is mounted on a hollow horizontal shaft, each shaft housing a fluid supply conduit for providing the high pressure cutting fluid from a single source to be distributed to each nozzle.

13. The bobbin stripping system of claim 5, wherein the streams of water intersect at a point of their contact on the outer surface of said bobbin.

14. The bobbin stripping system of claim 13, wherein the oscillating streams of water follow a reciprocating pattern which generally follows the longitudinal axis of the bobbin and is limited to the general length of such bobbin by means of controlling the rotation angle of each gear.

15. The bobbin stripping system of claim 12, wherein said stripping device includes a hood within which the bobbin is conveyed by first conveyor means for roving cutting, said hood having an open front, a top, back, first side and second side, said bobbin being conveyed through an opening in said first side and said stripped bobbin exiting through an opening in said second side after being stripped.

16. The bobbin stripping system of claim 15, wherein the stripping device is located adjacent to the open front of said hood and disposed so that the high pressure streams of fluid are directed through said open front to the interior of said hood to contact a bobbin located therein.

17. The bobbin stripping system of claim 16, wherein the top and back divert residual water and waste rovings after cutting through an open bottom onto second conveyor means.

18. The bobbin stripping system of claim 17 wherein a settling chamber is located beneath said second conveyor means to catch water and waste roving run off.

19. The bobbin stripping system of claim 18, wherein the second conveyor means is sealed to prevent introduction of water, moisture or waste rovings into the interior mechanism of said conveyor.

20. The bobbin stripping system of claim 19, wherein the stripping device includes a clamping device which comprises a pneumatic cylinder mounted above the location where the bobbin is stripped, which automatically activates an engagement pad into pressure holding contact with the top of the bobbin to secure it from free rotation when contacted by the high pressure fluid stream.

* * * * *